US010143607B2

(12) United States Patent
Ravn

(10) Patent No.: US 10,143,607 B2
(45) Date of Patent: Dec. 4, 2018

(54) OPERATOR CHAIR

(71) Applicant: Norsap AS, Kristiansand (NO)

(72) Inventor: Andreas Ravn, Oslo (NO)

(73) Assignee: Norsap AS, Kristiansand (NO)

( * ) Notice: Subject to any disclaimer, the term of this patent is extended or adjusted under 35 U.S.C. 154(b) by 1 day.

(21) Appl. No.: 15/246,824

(22) Filed: Aug. 25, 2016

(65) Prior Publication Data

US 2017/0055713 A1 Mar. 2, 2017

(30) Foreign Application Priority Data

Sep. 1, 2015 (NO) ..... 20151111

(51) Int. Cl.
*A61G 5/14* (2006.01)
*A61G 5/12* (2006.01)

(52) U.S. Cl.
CPC ..... *A61G 5/14* (2013.01); *A61G 5/122* (2016.11); *A61G 5/125* (2016.11); *A61G 5/127* (2016.11)

(58) Field of Classification Search
CPC ..... A61G 5/14
USPC ..... 297/330
See application file for complete search history.

(56) References Cited

U.S. PATENT DOCUMENTS 3,902,755 A 9/1975 Sirot
4,173,372 A * 11/1979 Norris ..... A61G 15/02 297/330
4,637,652 A * 1/1987 Bergenwall ..... A47C 1/035 297/330 X
6,672,668 B1 * 1/2004 Boruta, IV ..... A61G 15/005 297/330

FOREIGN PATENT DOCUMENTS

| | | |
|---|---|---|
| EP | 0555025 | 8/1993 |
| EP | 1859765 | 11/2007 |
| EP | 2997946 | 3/2016 |
| SE | 457709 | 1/1989 |

OTHER PUBLICATIONS

Norwegian Search Report, Norwegian Patent Application No. 20151111, date of report Apr. 1, 2016.

* cited by examiner

*Primary Examiner* — Anthony D Barfield

(74) *Attorney, Agent, or Firm* — Andrus Intellectual Property Law, LLP

(57) ABSTRACT

An operator chair comprises: a connection portion; a first parallel arm linkage to which an adjustable seat module is connected, the first parallel arm linkage being rotatably connected to the connection portion and to an armrest; a first actuator for driving the first parallel arm linkage between a first position and a second position, and thereby regulating a seat portion of the seat module between a first, substantially horizontal position corresponding to a sitting position of a user, and a second, at least partially vertical position corresponding to an at least partially standing position of the user, respectively; a second parallel arm linkage rotatably connected to the static fundament and to the connection portion; and a second actuator for driving the second parallel arm linkage so as to regulate at least the vertical position of the connection portion relative to the fundament.

9 Claims, 14 Drawing Sheets

OPERATOR CHAIR

FIELD

The present invention relates to an operator chair. More specifically the invention relates to an operator chair comprising an adjustable seat module, an armrest and a static fundament, wherein the adjustable seat module may be adjusted and moved in such a way that the operator chair may be used by users of different sizes and proportions both in a sitting position and in an at least partially standing position.

BACKGROUND

From an ergonomic point of view, it is an advantage during long working hours that it is possible for an operator to shift his working position between a sitting position and a standing, or at least partially standing, position. Shifting working position makes sure blood circulation and the general comfort of the user are maintained. At the same time it is a requirement that operator chairs should be possible to adapt to users of different sizes and/or anthropometries (proportions) so as to ensure satisfactory ergonomics. For adapting an operator chair to users of different anthropometries, it is desirable to be able to adjust the operator chair according to the user's length of lower legs, length of thighs, length of underarms and height of elbows. However, it has been shown to be very challengeable to combine ergonomic shifting of working position with a plurality of anthropometric settings in a satisfactory manner.

Wheelchairs and hospital beds are known for making use of various solutions for shifting between sitting/laying positions and standing positions, both manually and power-assisted. Different solutions are also known that shift the angle of a seat while maintaining a constant backrest angle. However, the known solutions do not combine the possibility to shift position with a plurality of anthropometric adjustments/settings. In particular, none of the known solutions maintain the anthropometric settings while shifting the position of the chair/bed between a sitting/laying position and a standing position as well is in any intermediate position.

In operator chairs according to the prior art, the height of the chair has normally been adjustable by means of a linear lifting column. The required lifting height, which typically is in the order of half a meter or more, requires the use of telescopic linear guides and actuators that also need to extend down through the floor in order to achieve a required overlap between linearly gliding parts. The whole linear construction also needs to be protected by telescopic covers to ensure the safety of the user. In sum this makes the lifting arrangement of the chair very large, and thus very unpractical for a chair that is to be of use to operators of different sizes and anthropometries.

A further challenge with operator chairs according to the prior art, including those with a linear lifting column, is the positioning of internal cables and cable guides. Excessive movement and bending of cables lead to wear and reduced lifetime. In a standard, linear lifting column, the cable guide will be hanging freely in a U-shape inside the column, and then move half the distance of the chair while it's lifted and lowered.

SUMMARY

It is an object of the invention to provide an operator chair in which a user may shift his working position between a sitting position and an at least partially standing position, where at the same time the operator chair may be adjusted so as to adapt to the size and anthropometry of different users so as attend to the user's ergonomics in the operator chair's different positions. It is also an object of the invention to provide an operator chair in which anthropometric settings are maintained in the different working positions of different users, so that the settings only have to be set once for each user. It is a further object of the invention to provide an operator chair with minimal moving and bending of internal cables and cable guides.

The invention has for its general object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

More specifically the invention is related to an operator chair comprising an adjustable seat module, an armrest and a static fundament, said adjustable seat module including a seat portion, wherein said operator chair further comprises:

- a connection portion;
- a first parallel arm linkage to which said adjustable seat module is connected, said first parallel arm linkage being rotatably connected to said connection portion and to said armrest:
- a first actuator for driving said first parallel arm linkage between at least and first position and a second position, and thereby regulating the seat portion of said seat module between at least a first, substantially horizontal position corresponding to a sitting position of a user, and a second, at least partially vertical position corresponding to an at least partially standing position of a user, respectively;
- a second parallel arm linkage rotatably connected to said static fundament and to said connection portion; and
- a second actuator for driving said second parallel arm linkage so as to regulate at least the vertical position of the connection portion relative to said static fundament.

The invention solves the above-mentioned challenges and drawbacks by combining an adjustable seat module, with adjustments for various anthropometric settings, with a set of actuators and parallel arm linkages. The actuators and parallel arm linkages may shift the position of the seat portion of the seat module from substantially horizontal, corresponding to a sitting position of a user, to an at least partially vertical position corresponding to an at least partially standing position of the user. The first actuator and parallel arm linkage is connected to the adjustable seat module, the adjustable seat module thus following the movement of the first parallel arm linkage. The second actuator and parallel arm linkage connects the first parallel arm linkage, and thereby also the seat module, to the static fundament via the connection portion, thereby being able to lift and lower the connection portion, and thus also the seat module, relative to the static fundament. This implies that the anthropometric adjustment of the length of the lower legs may be ensured by driving the second parallel arm linkage. Other anthropometric settings may be ensured by the adjustable seat module, as will be described below.

In an alternative embodiment, also described herein, each parallel arm linkage may be replaced by two independently operateable rotation joints, though such a solution would require more parts, separate actuators for each joint, more cabling and higher control requirements. The first parallel arm linkage also gives an advantageous horizontal stiffness of the armrest that will be lost by using regular rotation joints.

In a preferred embodiment, the seat module may comprise a backrest and a backrest actuator, where said backrest may be rotatably connected to said seat portion of the seat module and where said backrest actuator may be synchronized with said first actuator for keeping said backrest in a substantially upright, constant position regardless of the position of said seat portion. The regulation of the backrest position may be achieved by synchronizing the backrest actuator with the first actuator in such a way that the backrest actuator rotates the backrest relative to the seat portion at the same speed but in the opposite direction as the seat module's, and thus seat portion's, rotation relative to the connection portion. Depending on the type of actuator that is being used, the synchronization may be electrical and/or mechanical as will be understood by a person skilled in the art and therefore not discussed in further detail herein.

In one embodiment said adjustable seat module may be provided with adjustment means, where each adjustment means may have a plurality of settings, for adapting said operator chair to users of different sizes and/or proportions by adapting to one or more of the following:

length of thighs;

length of underarms; and height of elbows.

The different adjustment means may preferably be power-assisted by means of various actuators, though seat modules where one or more of the above-mentioned adjustments are fully or partially manual are also within the scope of the present invention. For detailed information of the various adjustment possibilities, reference is made to the subsequent part of the description referring to the drawings. It is also worth noting that the operator chair may be adjusted to the length of the lower legs of a user by means of the second parallel arm linkage and the second actuator, and not by any adjustment of the seat module itself. The full set of anthropometric adjustments is thus ensured by a combination of the seat module and the second parallel arm linkage.

In one embodiment said adjustable seat module and said second parallel arm linkage may be adjustable so that the knees of users of different sizes and proportions, when sitting/standing in the operator chair, are adjacent said connection portion, at least when the seat portion is in its substantially horizontal position. The connection portion of the operator chair may thus equally well be described as a knee portion. By placing this connection portion adjacent the knee of a user of the operator chair, the movement of the operator chair, when shifting between a sitting and an at least partially standing position of a user, may in many aspects mimic the natural movement of the user itself when shifting between the different positions. For a user of average size, the operator chair may be adjusted so that the connection portion is at a substantially fixed, spatial position adjacent the user's knee at all times when shifting position of the chair, implying that the second parallel arm linkage and appurtenant second actuator will not be moving. For smaller and larger users, there will be a small movement of the connection portion in order for the seat portion of the seat module to support the underside of the thighs of the user in all positions. The position and functionality of the connection portion also enable the use of fixed anthropometric settings for the seat module in all working positions of the user, implying that the seat module settings need not be changed when adjusting said seat portion between its substantially horizontal position and its at least partially vertical position. In fact, the anthropometric settings of the seat module need only be set once for each user.

In one embodiment the armrest may be provided with operating means for operating an external object. The operating means may for instance be a joystick and/or a control panel/pad with plurality of buttons for operating the external object that e.g. may be a lifting crane or various drilling- and/or rig-related equipment, etc.

In one embodiment said first and second actuators may be electric actuators. Any actuators embedded in the seat module, including any backrest actuator, may also be electric. The actuators may be controlled in a direct/analogue manner by means of a panel of buttons or the like on the operator chair, such as on the armrest. Alternatively, the user's anthropometric, and possibly also biometric, data may be fed into a control unit external to the chair, the control unit further being adapted to control the various actuators through calculations of resulting actuator positions as will be understood by a person skilled in the art.

In another embodiment said first and second actuators may be pneumatic actuators, typically in the form of pneumatic springs. When using pneumatic actuators, the user may need to carry his/her own weight upon shifting from a sitting to an at least partially standing position, as the pneumatic actuators may not be powerful enough to carry both the weight of the user and the chair.

In a preferred embodiment, the seat of said adjustable seat module may be placed in any position between its substantially horizontal position and its at least partially vertical position. Even more preferably, the seat portion may be placed in any position between a substantially horizontal and a substantially vertical position. It may be of great importance to be able to vary the working position between the extremities of the chair settings, for instance making it possible for the user to be fully sitting, fully standing and to take any position in between.

In one embodiment the operator chair may be provided with an exoskeleton protecting and covering at least a portion of said first and second arm linkages, said first and second actuators, said seat module and said armrest. The exoskeleton may contribute to increasing the robustness and strength of the operator chair. Further, the exoskeleton may cover the movable constituents of the operator chair so as to improve safety. Finally, the exoskeleton may also give the operator chair a more aesthetic appearance.

In one embodiment the operator chair may comprise:

- a pair of connection portions, one on each side of said seat module;
- a pair of first parallel arm linkages, one on each side of said seat module;
- a pair of first actuators, one on each side of said seat module;
- a pair of second parallel arm linkages, one on each side of said seat module;
- a pair of second actuators, one on each side of said seat module; and
- a pair of armrests, one on each side of said seat module.

It may be an advantage if the operator chair is more or less symmetric about the seat module, except for joysticks and buttons or the like on the armrests, as it may give better lifting power and stability for the operator chair.

BRIEF DESCRIPTION OF THE DRAWINGS

In the following are described examples of preferred embodiments illustrated in the accompanying drawings, wherein.

DETAILED DESCRIPTION OF THE DRAWINGS

Figure 1:
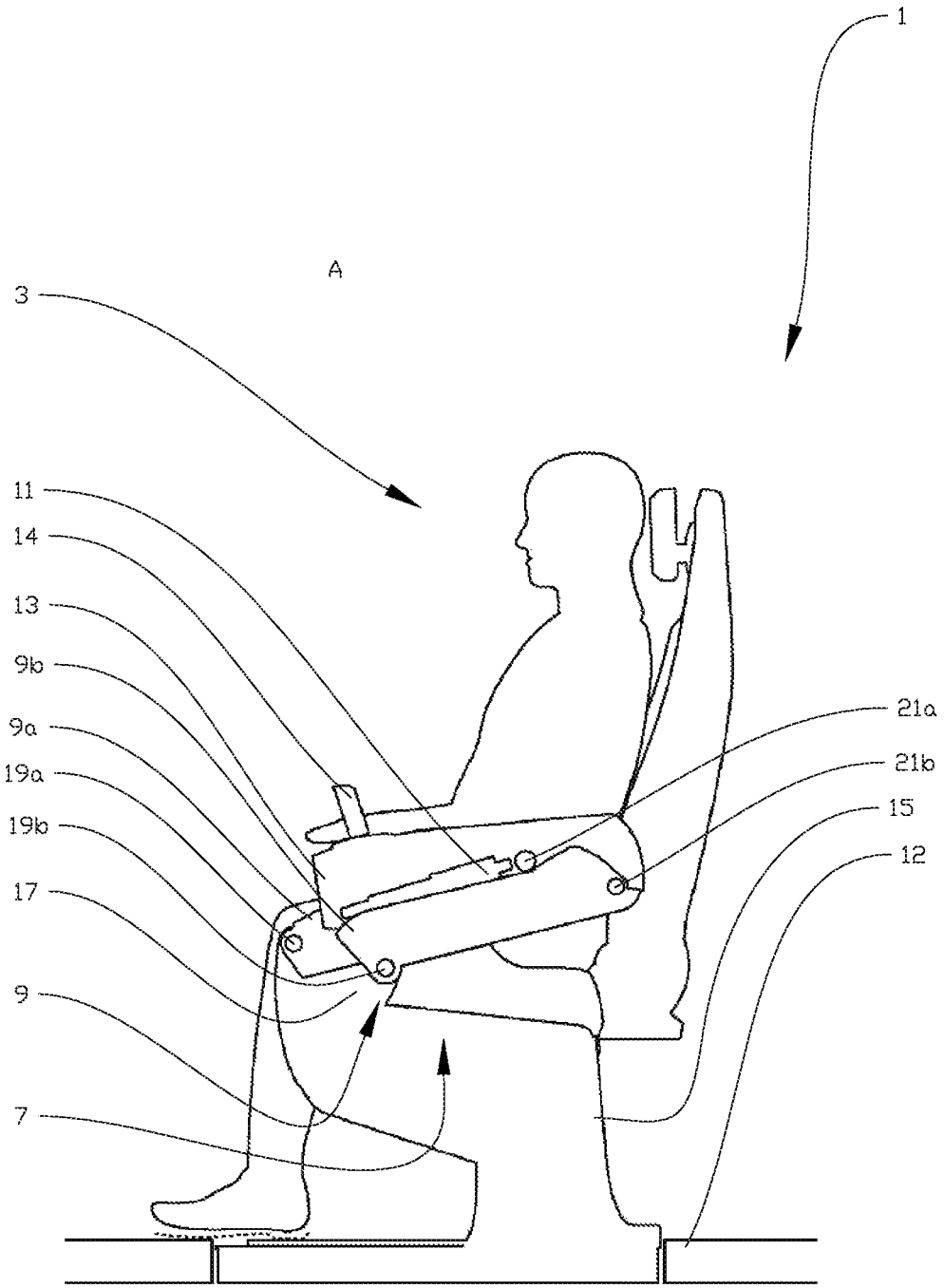
FIGS. 1-4 show, in a side-view, an operator chair according to the present invention in different positions of use with a large user.

In the following, the reference number 1 will indicate an operator chair according to present invention. Identical reference numerals will indicate identical or similar features in the drawings. The drawings are simplified and schematic, and the various features in the drawings are not necessarily drawn to scale. The same operator chair 1 is shown on all figures, though different components/constituents of the operator chair 1 are highlighted in the different drawings. The reference number 3 will refer to a large user, i.e. a user above average size, while the reference number 5 will indicate a small user, i.e. a user of below average size.

Figure 2:
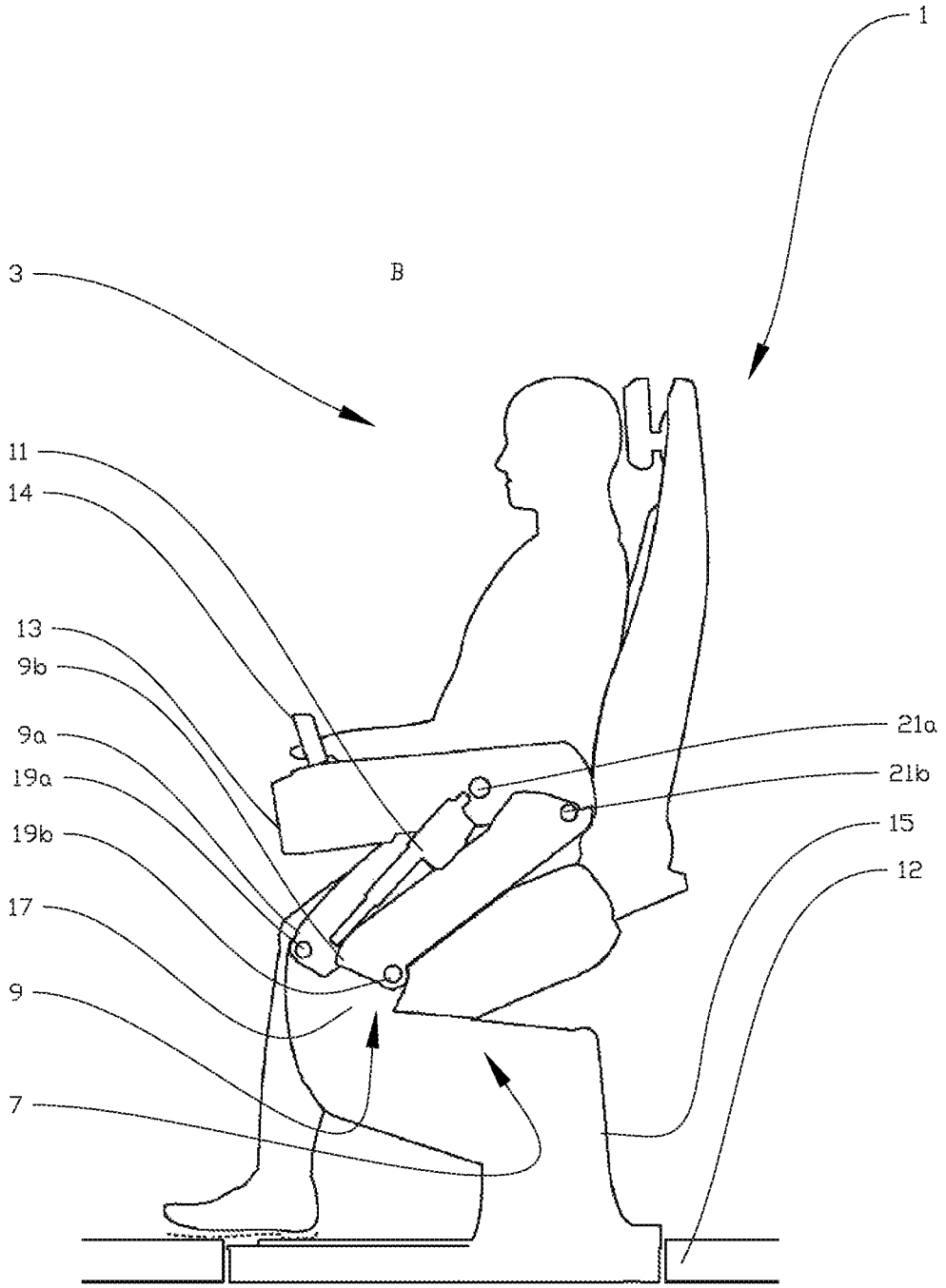
Figure 3:
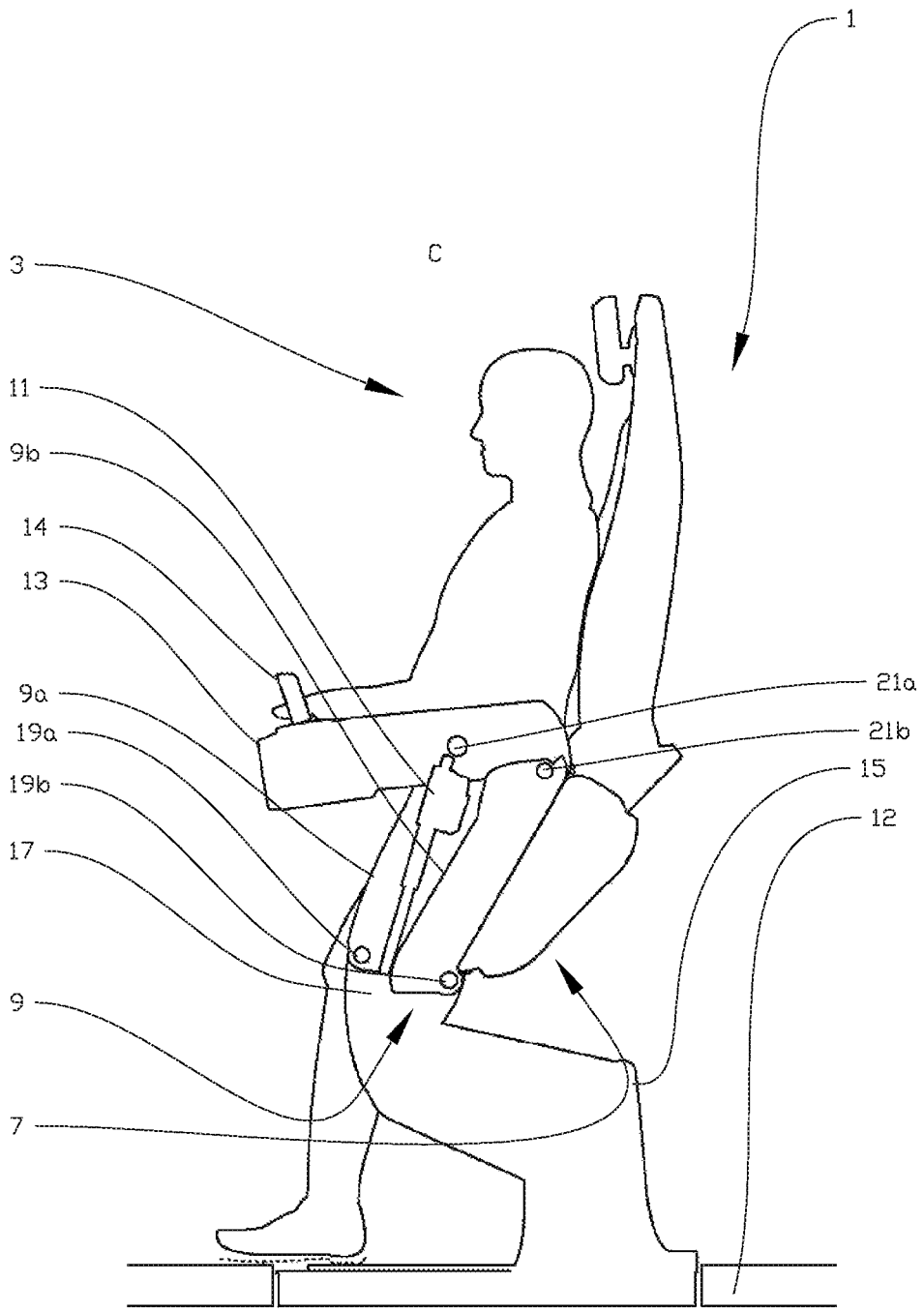
Figure 4:
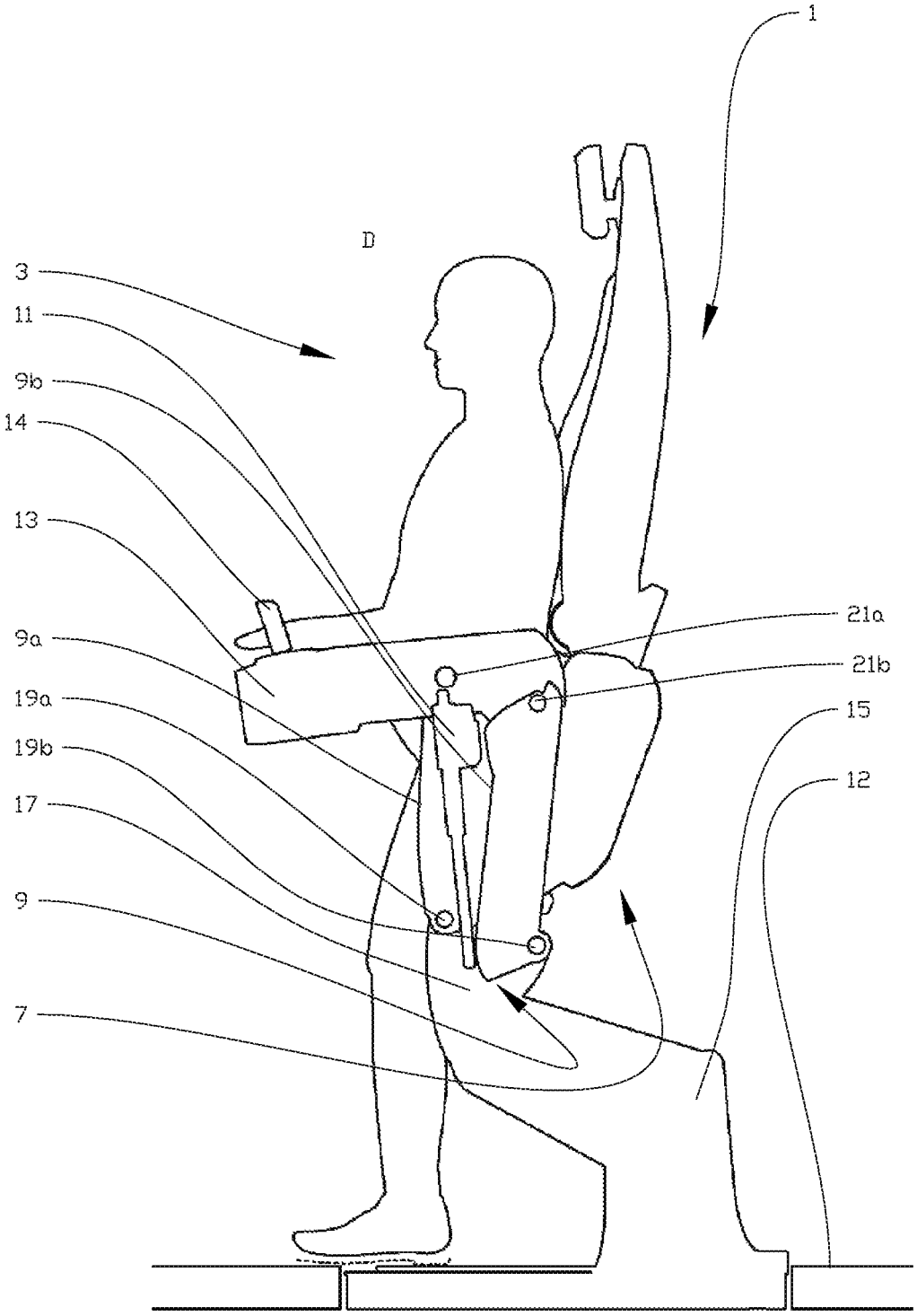

FIGS. 1-4 show, in series, a large user 3 gradually shifting his position in the operator chair 1 from a sitting position A in FIG. 1 to a fully standing position D in FIG. 4, via a ⅓ standing position B in FIG. 2 and a ⅔ standing position C in FIG. 3. In the figures, a seat module 7, a first parallel arm linkage 9, a first actuator 11 and an armrest 13 are highlighted, while other parts and constituents of the operator chair 1 will be highlighted in and discussed with reference to the remaining figures. The operator chair 1 is placed on and connected to, via connection means not shown, a floor 12 via a static fundament 15. The first parallel arm linkage 9 includes a first and a second parallel arm 9*a*, 9*b*, rotatably connected to a connection portion 17, not highlighted in FIGS. 1-4, in rotation axes 19*a*, 19*b*, respectively, and rotatably connected to the armrest 13 in rotation axes 21*a*, 21*b*, respectively. The first actuator 11 shifts the first parallel arm linkage 9 in different parallelogrammic positions by extending and retracting. The seat module 7 is connected to the first arm 9*a* of the first parallel arm linkage 9 and thus follows the movement of the first arm 9*a*. The armrest 13 is raised by the movement of the first parallel arm linkage 9 from the user's 3 seated position A in FIG. 1 to his standing position D in FIG. 4, but keeps a constant, substantially horizontal position supporting the user's 3 underarm in all positions A-D. The armrest 13 is provided with operating means 14, here shown in the form of a joystick, for the control of an external object, such as a lifting crane.

Figure 5:
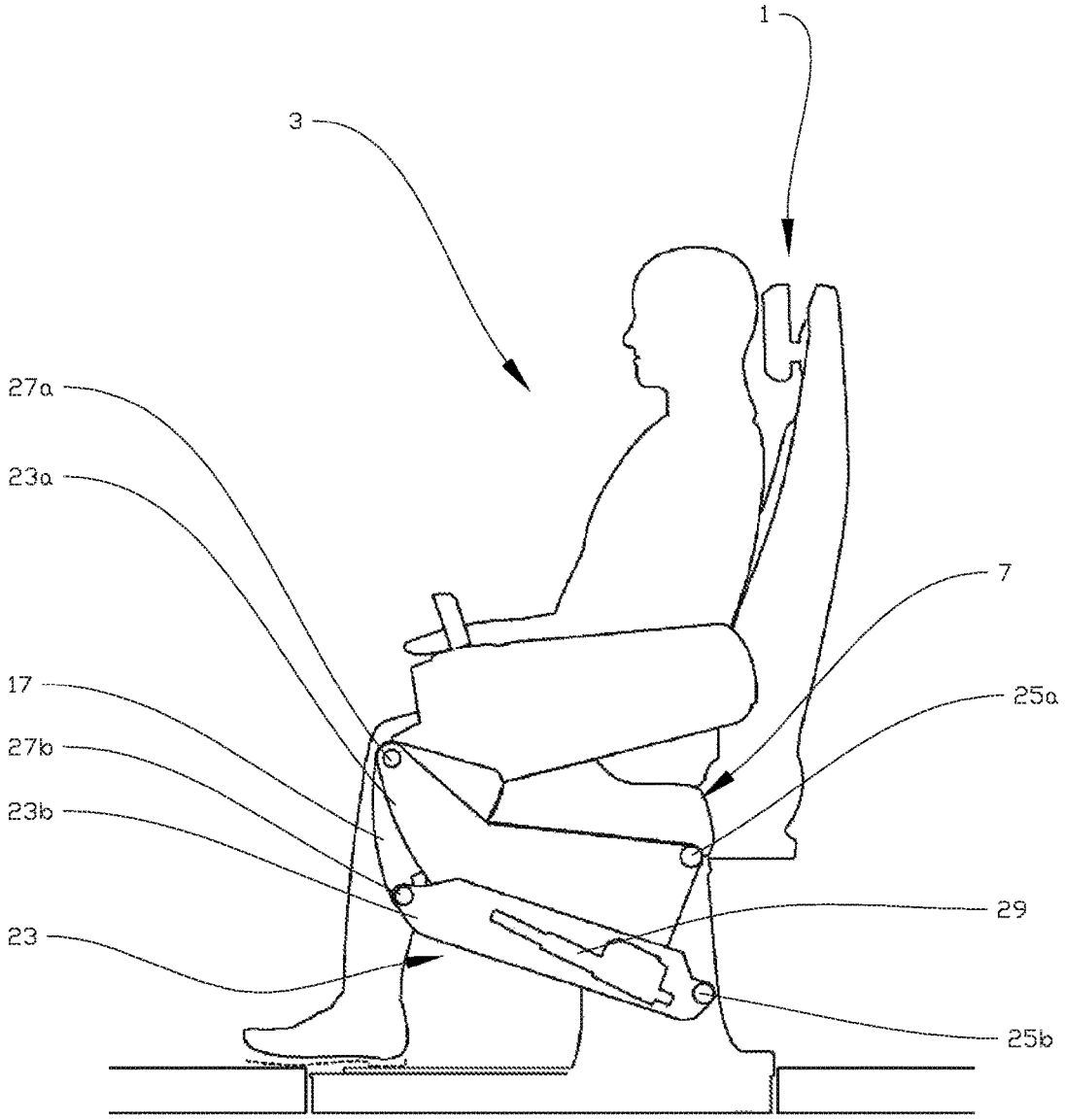
FIGS. 5-6 show, in a side view, an operator chair with a large and a small user seated in the chair, respectively.
Figure 6:
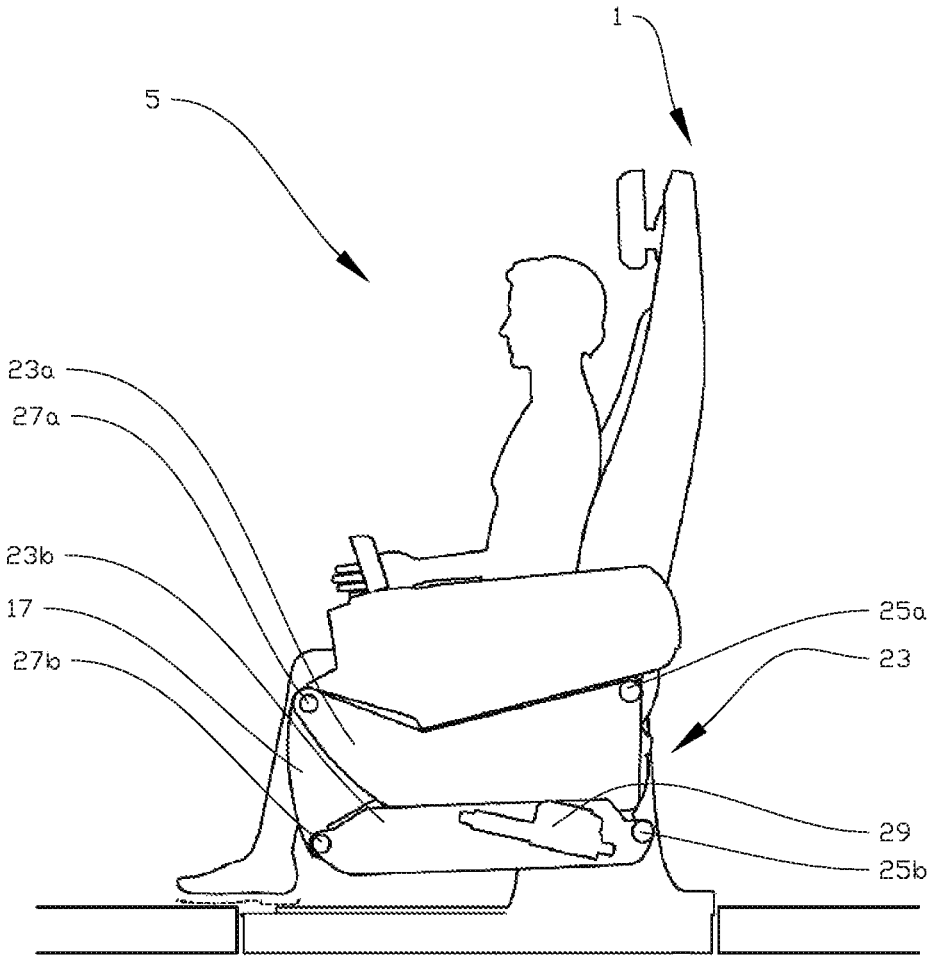

FIGS. 5 and 6 show the operator chair 1 with some highlighted details of the connection portion 17 and a second parallel arm linkage 23. The second parallel arm linkage includes a first arm 23*a* and a second arm 23*b*, the first and second arms 23*a, b* being rotatably connected to the static fundament 15 in first and second rotations axes 25*a, b*, respectively, and rotatably connected to the connection portion 17 in first and second rotation axes 27*a, b*, respectively. A second actuator 29 extends and retracts in order to shift the second parallel arm linkage 23 and thus to lift and lower the connection portion 17, respectively. FIG. 5 shows the basic setting of the parallel arm linkage 23 for a large user 3 sitting in the operator chair 1, while FIG. 6 shows the corresponding setting for a small user 5. Note that the connection portion 17 is placed substantially adjacent the knee of the users 3, 5 in both figures. The second parallel arm linkage 23 enables adjusting the operator chair 1 according to the user's length of the lower legs. All other anthropometric settings are enabled in the seat module 7, as will now be explained.

Figure 7:
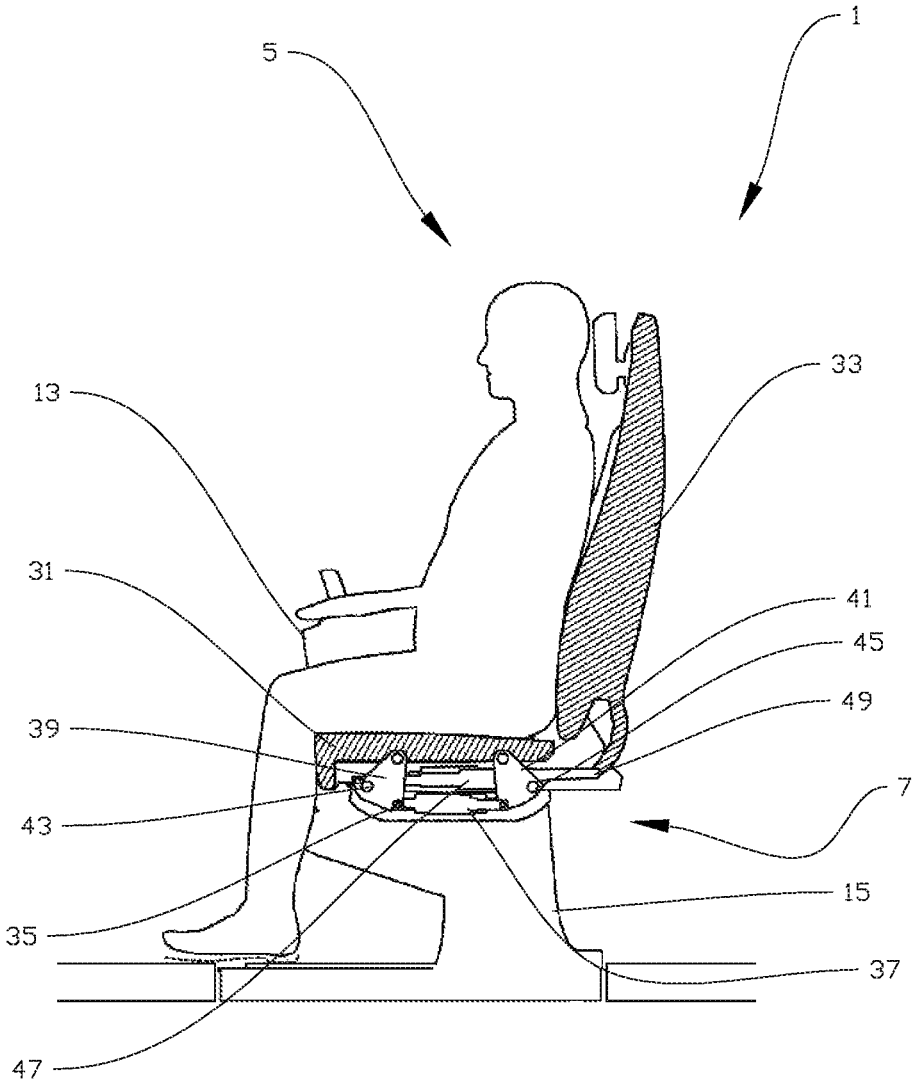
FIGS. 7-8 shows, in a side view, various settings of the adjustable seat module with a large and a small user seated in the chair, respectively.
Figure 8:
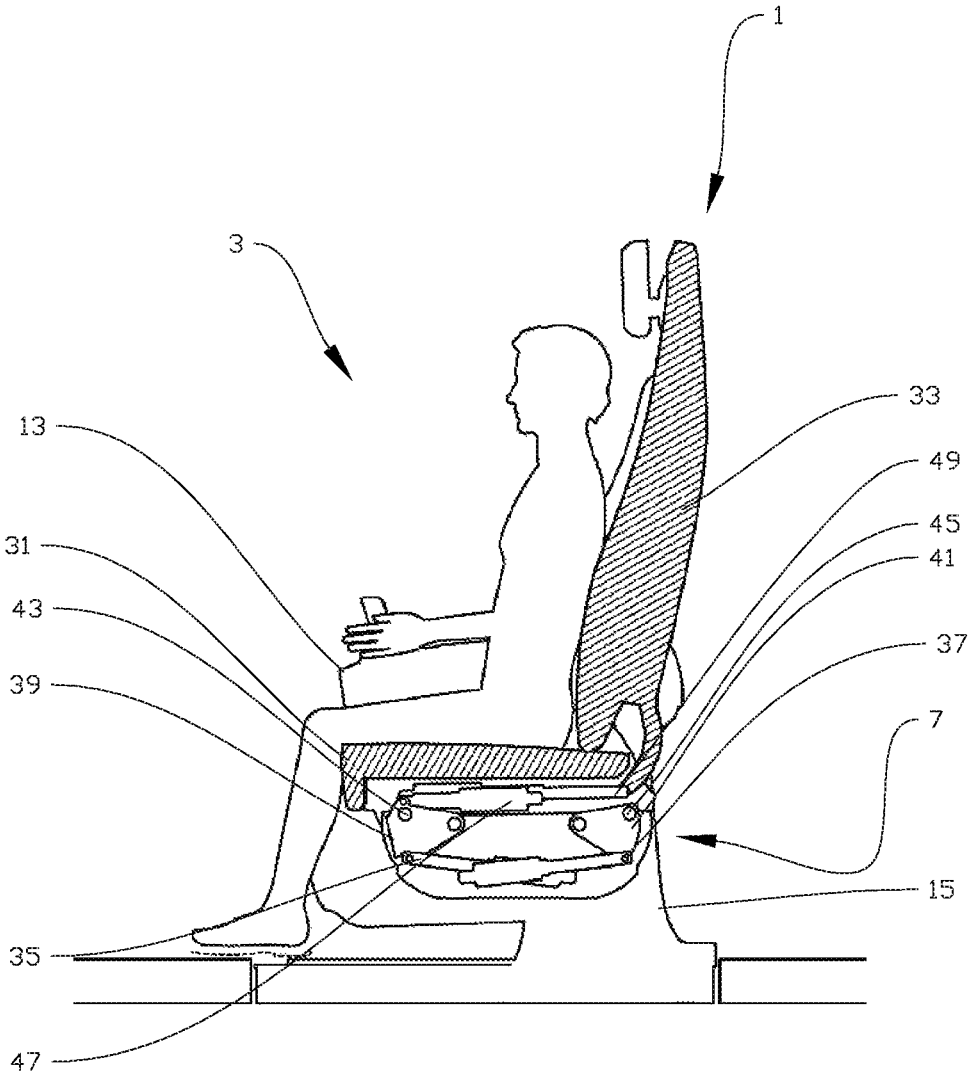

Reference is now made to FIGS. 7 and 8, where in FIG. 7 the seat module 7 is adjusted for a large user 3 sitting in the operator chair, while in FIG. 8 the seat module 7 is adjusted for a smaller user 5 seated in the operator chair 1. The seat module 7 may be adjusted according to the elbow height of a user 3, 5 by vertically lifting or lowering a seat portion/sitting portion 31 and a backrest 33 of the seat module 7 relative to the armrest 13 and the static fundament 15. This implies that the armrest 13 itself does not move. In the shown embodiment, the vertical lifting and lowering movement is enabled by simultaneously extending and lowering, respectively, first and second seat module actuators 35, 37 rotatably connected to the seat portion 31 via brackets 39, 41 connected to the seat portion 31 in rotation axes 43, 45, respectively. The first and second seat module actuators 35, 37 are in an extended position in FIG. 8 so as to lift the seat portion 31 and the backrest 33 relative to the armrest 13 for adapting the operator chair 1 to the height of the elbows of the small user 5. Similarly, in FIG. 7, the first and second seat module actuators 35, 37 are in a retracted position, so as to lower the seat portion 31 and the backrest 33 relative to the armrest 13. It should be noted that the second parallel arm linkage 23 also is set differently in the two figures as discussed above.

The seat module 7 is further provided with a third seat module actuator 47 adapted to displace the seat portion 31 and the backrest 33 linearly, horizontally relative to the armrest 13 and the static fundament 15. The third seat module actuator 47 thus makes it possible to adjust the operator chair 1 according to the length of the underarm of a user 3, 5, by adjusting the horizontal distance between the backrest 33 and the joystick 14 on the armrest 13. FIGS. 7 and 8 show an extended and retracted third seat module actuator, respectively, for adjusting the operator chair 1 to the large user 3 and the small user 5, respectively.

The seat portion 31 is also linearly, horizontally movable relative to the backrest 33 in order to adjust the operator chair 1 according to the length of the thighs of a user. The horizontal movement of the seat portion 31 is enabled by a fourth, not shown, seat module actuator. FIG. 7 shows the horizontal setting of the seat portion 31 relative to the backrest for the large user 3, while FIG. 8 shows the corresponding setting for the small user 5.

As discussed in the general part of the description, all seat module actuators may be controllable by a not shown panel on the armrest 13, or elsewhere on the operator chair 1, or the actuators may be controlled by an external control unit, not shown. In an alternative embodiment, one or more of the seat module settings may be manually adjustable.

Figure 9:
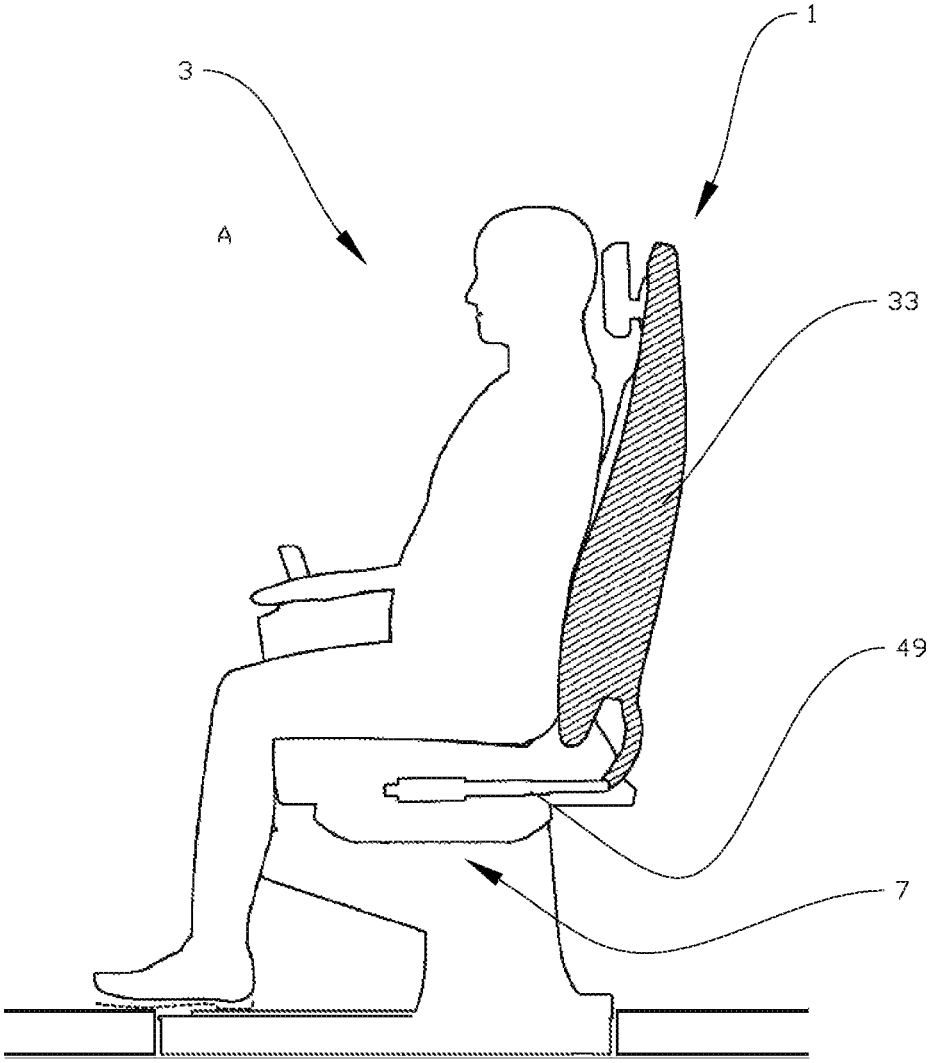
FIGS. 9-12 show, in a side view, an operator chair according to the present invention and the functionality of the backrest and the backrest actuator in different positions of use.
Figure 10:
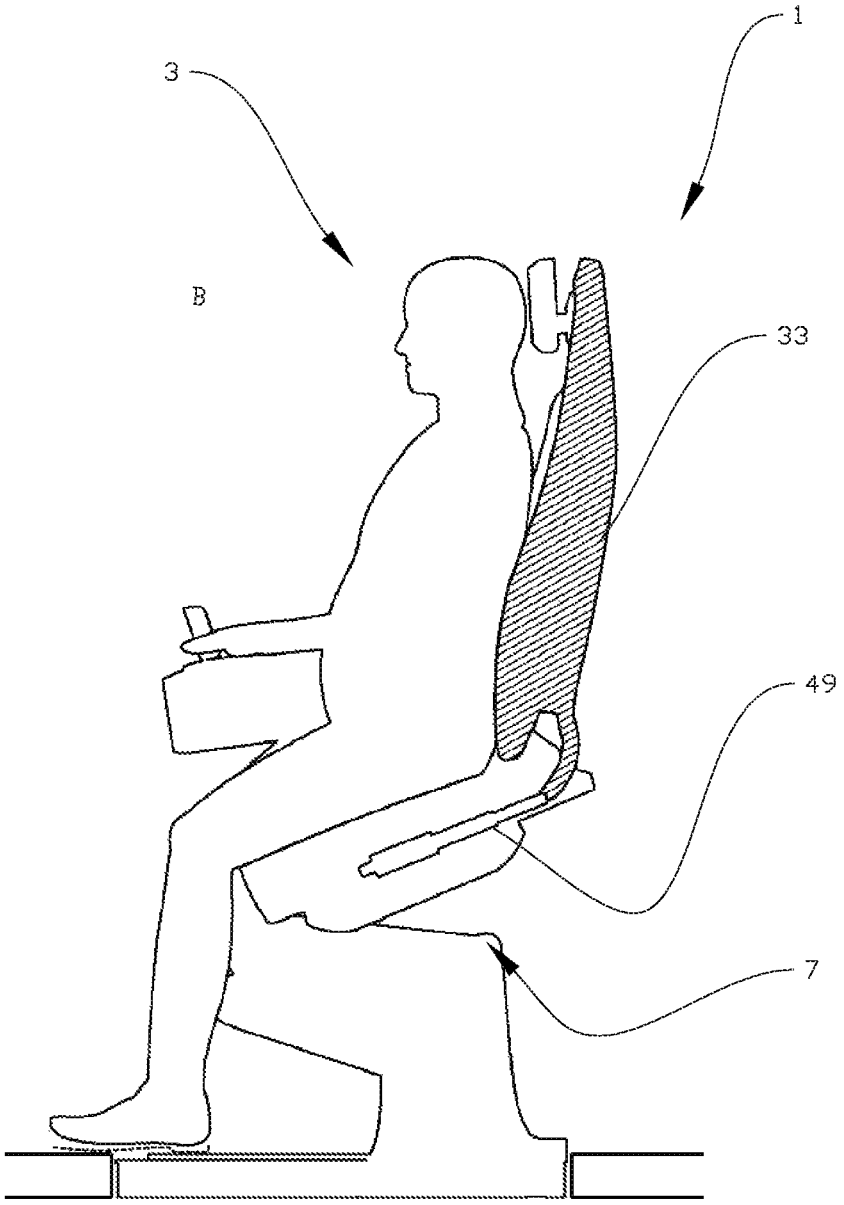
Figure 11:
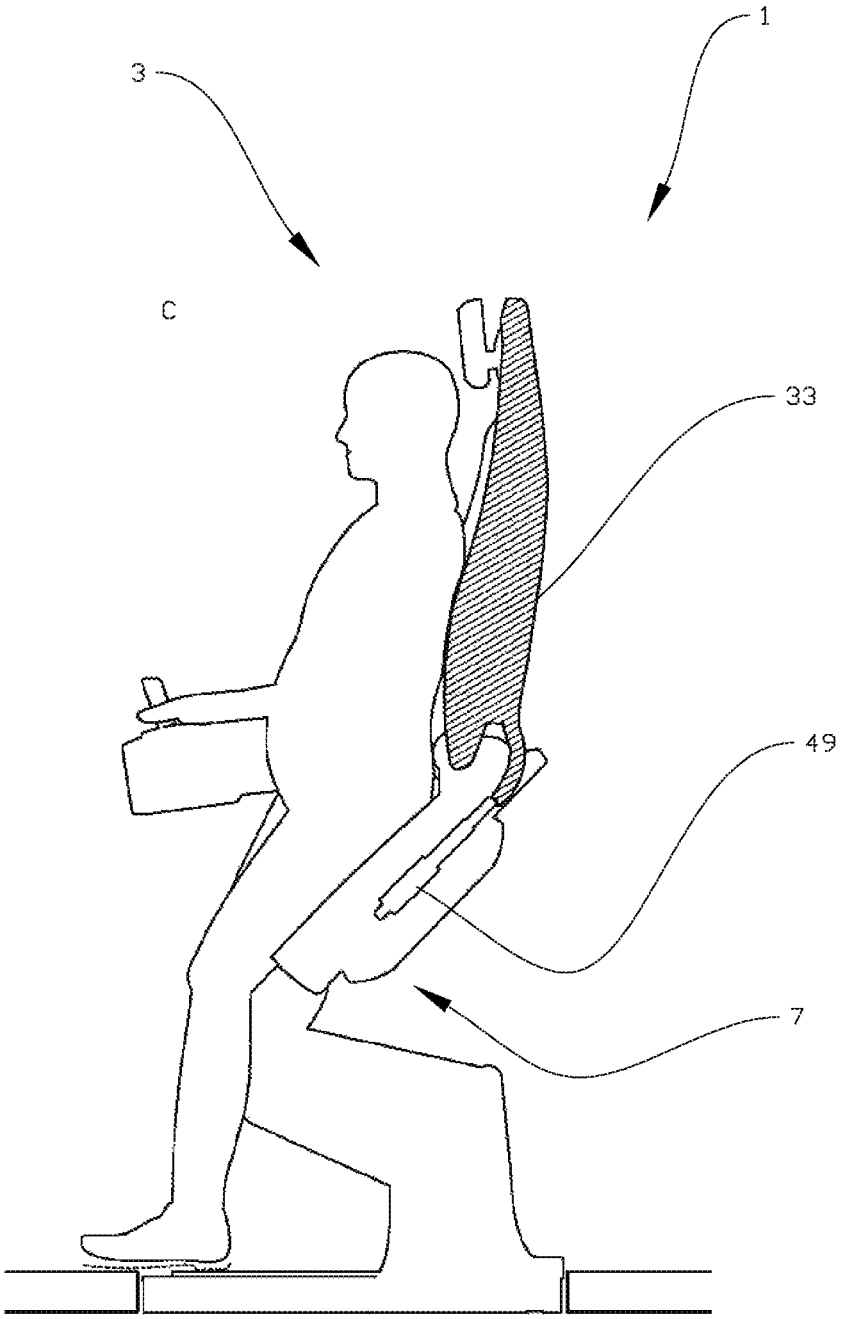
Figure 12:
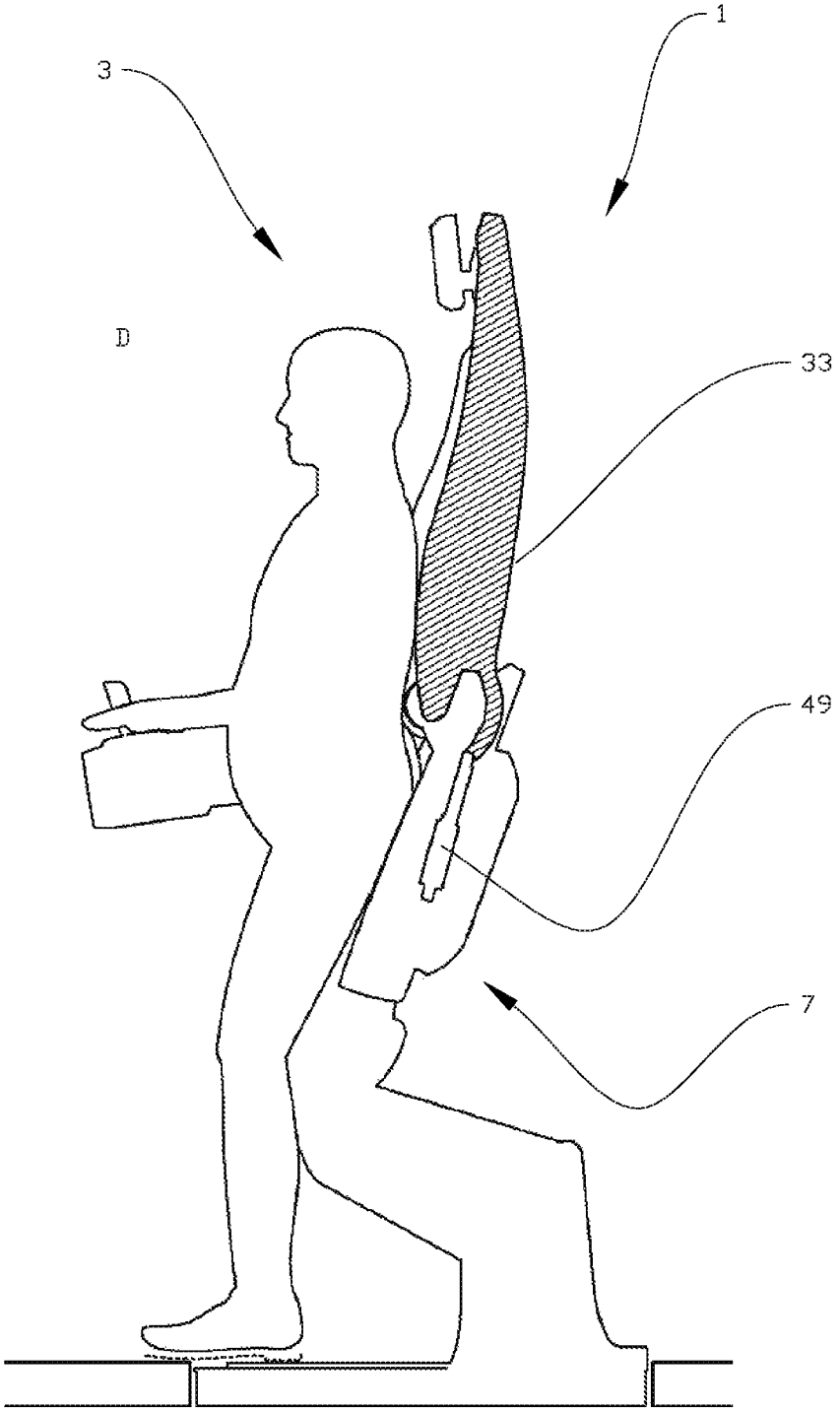

The seat module 7 also includes a backrest actuator 49 adapted to regulate the angle of the backrest 33 relative to the seat portion 31. The backrest actuator 49 and its functionality will now be described with reference to FIGS. 9-12, which show different positions of the operator chair 1 while the large user 3 shifts from a sitting position A in FIG. 9 to fully standing position D in FIG. 12, via a ⅓ standing position B in FIG. 10 and a ⅔ standing position C in FIG. 11. As can be seen from the figures, the backrest 33 maintains a constant, substantially vertical position in any position of the large user 3 from sitting A to fully standing D, irrespective of the angle of the seat portion 31 relative to the static fundament 15. The constant backrest 33 angle functionality is enabled by synchronizing the backrest actuator 49 with the first actuator 11 driving the first parallel arm linkage 9, so that the backrest actuator 49 rotates the backrest 33 a similar angle, but in the opposite direction compared to the seat portion's 31 rotation relative to the connection portion 17, as shown in FIGS. 1-4. Different ways of synchronizing were briefly mentioned above.

Figure 13:
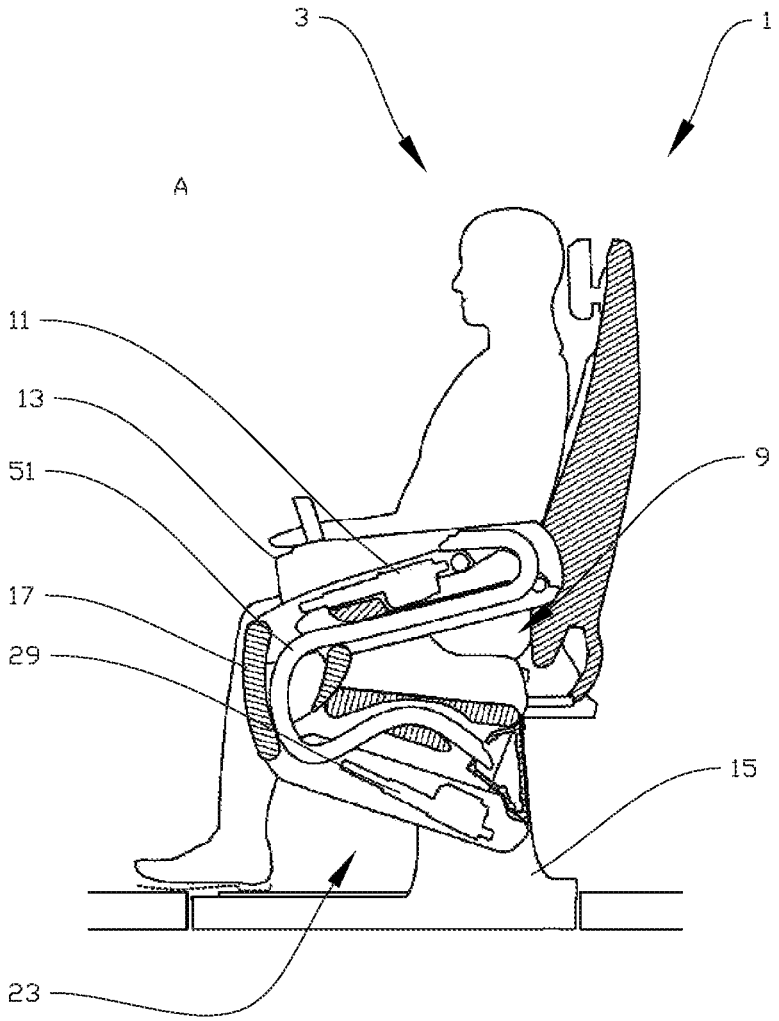
FIGS. 13-14 show, in a side view, an operator chair according to the present invention and the position of a cable guide in different positions of use.
Figure 14:
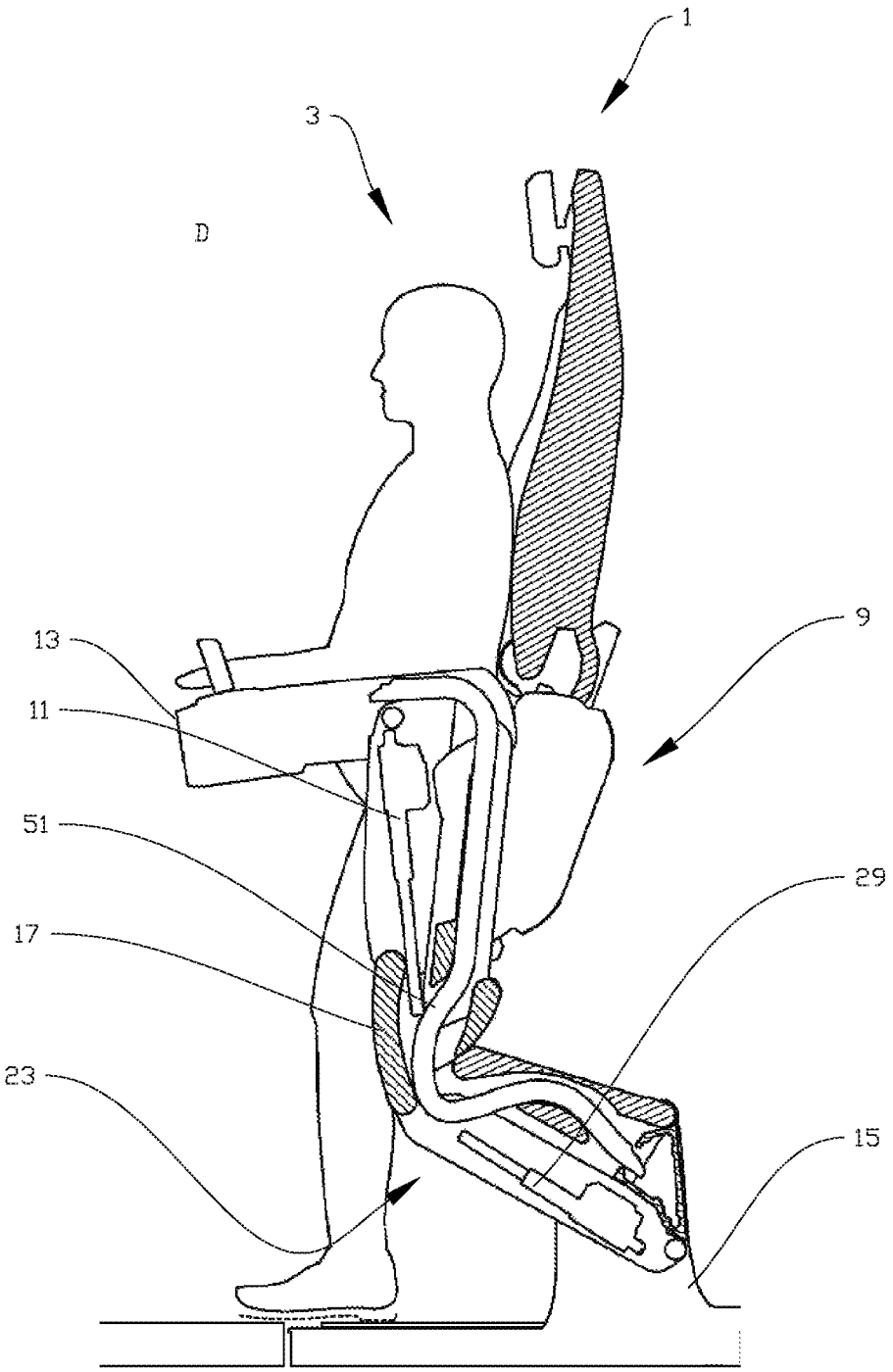

FIGS. 13 and 14 show how a cable guide 51 extends through the operator chair 1 from the static fundament 15 to the armrest 13, along the second parallel arm linkage 23, the connection portion 17 and the first parallel arm linkage 9. The cable guide 51 surrounds and protects a plurality of not shown cables transferring power and communication to various components of the operator chair 1, though a person skilled in the art will also understand that communication may be transferred in a wireless manner. The cable guide 51 further protects said various cables from being squeezed between moving parts of the operator chair 1, prevents excessive bending of the cables as well as keeps the cables in a bundle. The figures show how the shown cable guide 51 only is bent at the connection portion 17 and between the armrest 13 and the backrest 33 as the large user 3 shifts between a sitting position A in FIG. 13 and a standing position D in FIG. 14, while the remaining parts of the cable guide 51 is kept substantially fixed relative to the operator chair 1 in all positions of use of the operator chair 1. This minimal movement and bending of the cable guide upon shifting the operating position of the operator chair 1 reduces the risk of damage to the cables and thereby increases lifetime of the cables. The very compact design of the cable guide 51 with very little movement and bending also enable the first and second actuators 11, 29 to extend and retract relatively freely.

It should be noted that the above-mentioned embodiments illustrate rather than limit the invention, and that those skilled in the art will be able to design many alternative embodiments without departing from the scope of the appended claims. In particular, the different settings in the seat module 7 may be enabled in a variety of different ways without departing from the scope of the present invention. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. An operator chair having an adjustable seat module, an armrest and a static fundament, said adjustable seat module having a seat portion, wherein said operator chair further comprises:

a connection portion;

a first parallel arm linkage to which said adjustable seat module is connected, said first parallel arm linkage being rotatably connected to said connection portion and to said armrest;

a first actuator for driving said first parallel arm linkage between at least a first position and a second position, and thereby regulating the seat portion of said seat module between at least a first, substantially horizontal position corresponding to a sitting position of a user, and a second, at least partially vertical position corresponding to an at least partially standing position of a user, respectively;

a second parallel arm linkage rotatably connected to said static fundament and to said connection portion; and a second actuator for driving said second parallel arm linkage so as to regulate at least the vertical position of the connection portion relative to said fundament;

wherein said seat module further comprises a backrest and a backrest actuator, said backrest being rotatably connected to said seat portion and said backrest actuator being synchronized with said first actuator for keeping said backrest in a substantially upright, constant position regardless of the position of said seat portion.

2. The operator chair according to claim 1, wherein said adjustable seat module is provided with adjustment means, each adjustment means having a plurality of settings, for adapting said operator chair to users of different sizes or proportions by adapting to one or more of the following:

length of thighs;

length of underarms; and height of elbows.

3. The operator chair according to claim 2, wherein said adjustable seat module and said second parallel arm linkage are adjustable so that the knees of users of different sizes or proportions may be substantially adjacent said connection portion, at least when the seat portion is in the substantially horizontal position.

4. The operator chair according to claim 1, wherein said armrest is provided with operating means for operating an external object.

5. The operator chair according to claim 1, wherein the first and second actuators are electric.

6. The operator chair according to claim 1, wherein the first and second actuators are pneumatic.

7. The operator chair according to claim 1, wherein the seat portion of said adjustable seat module may be placed in any position between the substantially horizontal position and the at least partially vertical position.

8. The operator chair according to claim 1, wherein the operator chair is provided with an exoskeleton protecting and covering at least a portion of said first and second arm linkages, said first and second actuators, said seat module and said armrest.

9. The operator chair according to claim 1, wherein said operator chair comprises:

a pair of connection portions, one on each side of said seat module;

a pair of first parallel arm linkages, one on each side of said seat module;

a pair of first actuators, one on each side of said seat module;

a pair of second parallel arm linkages, one on each side of said seat module;

a pair of second actuators, one on each side of said seat module; and a pair of armrests, one on each side of said seat module.

* * * * *